United States Patent [19]

Pietreniak

[11] 4,096,311

[45] Jun. 20, 1978

[54] WIPE DRY IMPROVEMENT OF NON-WOVEN, DRY-FORMED WEBS

[75] Inventor: Eugene J. Pietreniak, Chester, Pa.

[73] Assignee: Scott Paper Company, Philadelphia, Pa.

[21] Appl. No.: 627,657

[22] Filed: Oct. 31, 1975

[51] Int. Cl.[2] ..... D21H 3/44; B22C 17/08; C11D 1/72; C11D 17/04

[52] U.S. Cl. ..... 428/289; 15/104.93; 162/168 R; 162/168 N; 128/296; 264/121; 252/DIG. 1; 252/91; 252/89 R; 427/365

[58] Field of Search ..... 15/104.93; 128/296; 252/DIG. 1, 89, 91; 427/228, 326, 365; 162/158 N, 158 R; 264/121; 428/289

[56] References Cited

U.S. PATENT DOCUMENTS

| | | | |
|---|---|---|---|
| 3,554,863 | 1/1971 | Hervey et al. | 162/158 N |
| 3,556,931 | 1/1971 | Champaigne | 162/158 N |
| 3,674,632 | 7/1972 | Wennergren | 162/158 R |
| 3,756,913 | 9/1973 | Wodka | 162/158 N |
| 3,846,158 | 11/1974 | Vasilyadis | 15/104.93 |
| 3,881,210 | 5/1975 | Drach et al. | 15/104.93 |
| 3,897,356 | 7/1975 | Pociluyko | 252/91 |

*Primary Examiner*—Michael R. Lusignan
*Attorney, Agent, or Firm*—Nicholas J. DeBenedictis; John W. Kane, Jr.

[57] ABSTRACT

Wipe-dry characteristics of non-woven, dry-formed webs are improved by a post-treatment process that adds water and a surfactant to the web followed by wet-working the web. The effectiveness of the surfactant for improving the wipe-dry capability is noticeably enhanced by working the web while it is still wet with the water and the surfactant. Preferred surfactant addition is from about 0.5% to about 3% by weight surfactant based upon the weight of the web.

22 Claims, 2 Drawing Figures

WIPE DRY IMPROVEMENT OF NON-WOVEN, DRY-FORMED WEBS

BACKGROUND OF THE INVENTION

1. Field of the Invention

This invention concerns dry formed, nonwoven webs and the treatment of such webs with surfactants.

2. Description of the Prior Art

Surfactants have been added to paper products mainly to result in a towel pretreated with a detergent surfactant. U.S. Pat. No. 3,897,356, inventor — Alex Pociluyko entitled "Windshield Wipers Containing Nonionic Surfactant" is an example of a paper product pretreated with a detergent surfactant. However, the '356 patent does not suggest the concept of wet working a web after the surfactant has been added to the web.

U.S. Pat. No. 3,686,025 discloses impregnating an absorbent material with a softening agent which is releasable from said absorbent material at a controlled rate. The product is intended for use during standard laundering of textile fabrics. The controlled release of the softening agent is intended for releasing the softening agent during washing of textiles. Although column 5, beginning at line 30 of the '025 patent discloses impregnating an absorbent substrate, preferably a nonwoven, water-laid or air-laid cloth. The patent disclosure does not suggest subsequent wet working or its effectiveness on the wipe dry property of a dry formed web.

U.S. Pat. No. 2,961,362 issued to Smith et al is representative of a large number of patents which disclose surface active agents applied to non-woven, dry-formed substrates. These patents are generally silent about the effectiveness of subsequent wet-working of the web or substrate and its effect upon the wipe dry characteristic of the web.

SUMMARY OF THE INVENTION

Wipe-dry characteristics of a dry formed web are improved by treating the web with water and a surfactant followed by wet-working the web. The effectiveness of the surfactant for improving the wipe-dry characteristics of the web is noticeably enhanced by the subsequent wet-working of the web. Preferred surfactant addition onto the web is from about 0.5% to about 3% based upon the untreated, dry weight of the web.

DETAILED DESCRIPTION OF THE INVENTION

Figure 1:
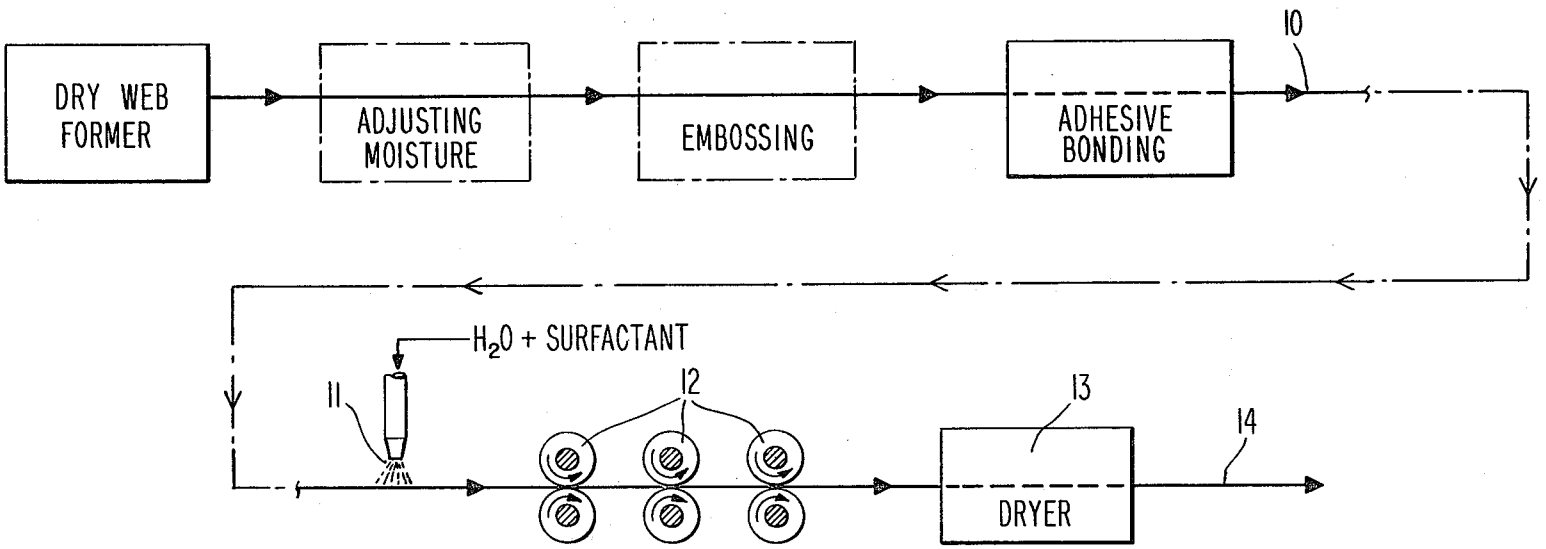
FIG. 1 depicts the process provided by the invention.

The present invention improves the wipe-dry characteristics of dry-formed webs. Dry-formed webs are a class of non-woven materials produced by processes other than the classical wet-lay paper process of slurring fibers in water and then forming the web by depositing the fibers on a foraminous surface through which the water passes. Dry-forming processes do not employ a water and fiber slurry and accordingly they are referred to as "dry" formed although moisture may be present during the forming process. Typical dry-formed non-woven webs are carded webs and air laid webs which are produced from papermaking and/or textile length fibers such as wood pulp fibers, cotton linters and synthetic fibers such as rayon, polyester and mixtures thereof. The fibers are dispersed in a gaseous fluid and deposited upon a foraminous surface to form the web. Apparatus for forming such webs are usually referred to as dry web formers and are available commercially under such product names as RANDO-FEEDER and RANDO-WEBBER. Most dry formed webs are adhesively bonded usually with a latex to give the web structural integrity. Often the adhesively treated web is dried to cure the adhesive. Sometimes moisture is added in minor quantities at various points in the production process but the webs are still referred to in the art as "dry-formed". Moisture may be added to produce some papermaking bonds (hydrogen bonds) which may reduce or eliminate the need for adhesive addition prior to addition of the water and surfactant.

Suitable dry-formed webs for practicing the present invention can be produced from textile-length fibers, paper length fibers or combinations thereof.

Specific examples of dry-formed webs and methods by which they are produced are contained in U.S. Pat. No. 3,862,472, issued to Norton et al, British Pat. No. 1,311,619 and British Pat. No. 1,246,910, which patents are incorporated herein with respect to their disclosure of dry-formed webs and their method of production.

Generally, the preferred dry-formed webs for practicing the present invention are produced from mixed fibers of textile-length and papermaking length which are suspended in air and deposited on a foraminous member to form an unbonded, low density mat (web) which is subsequently adhesively bonded and/or embossed with or without moisture followed by drying and curing of the adhesive if needed.

A particularly preferred web is sold by Scott Paper Company under the tradename ShopTowel ® which is a dry-formed web made from about 75% woodpulp and about 25% synthetic fibers having a basis weight in the range of about 50 to about 110 lbs./ream and which is adhesively bonded and embossed.

The present invention is particularly suitable for low density dry-formed webs because high density webs generally don't have the wipe-dry problems which are solved by the present invention. Webs having a density of less than about 0.16 gms/cc are preferred.

Suitable dry-formed, adhesively bonded webs are treated according to the present invention by adding an aqueous solution of a surfactant to the web followed by wet-working of the web to improve the wipe dry characteristics of the web. Preferred level of surfactant addition onto the web is at least about 0.5%. Particularly preferred is from about 0.5% to about 3% surfactant based upon the weight of the adhesively bonded web.

The aqueous solution of the surfactant generally contains at least about 1% surfactant with from about 4% to about 8% surfactant solids in the aqueous solution being preferred.

Surfactants suitable for practicing the present invention are any of the well known surface active agents which include the anionic, nonionic, cationic, and amphoteric surfactants and mixtures thereof. Many of the suitable surfactants are also known in the art as synthetic detergents. Specific examples of suitable surfactants are included in Table 2 appearing at the end of this application.

Wet-working, as the term is used herein, refers to the mechanically induced relative movement of fibers with respect to each other while the web is moist with the water and the surfactant. The moisture level added to the web should be sufficient to assist working of the web and distribution of the surfactant. Preferred water addition is about 30% or more and particularly preferred is from about 45% to about 55% water based upon the weight of the web. Moisture addition greater than about 80% should be avoided because little additional benefits are obtained while significant energy is required to subsequently dry the web.

Wet-working is normally accomplished by passing the web through the nip of rollers as shown in FIG. 1. When the web passes through nip 12 it is subjected to compressive forces which cause relative movement of the fibers with respect to each other. A single pass of the wet surfactant containing web through a light compression nip induces sufficient relative movement of the fibers in the web to enhance its wipe dry characteristics. However, the preferred amount of wet-working is for the web to be passed through a light compression nip about 5 times which tends to achieve the full benefits of the invention. Additional wet working of the web may further increase the wipe dry characteristics but the amount of improvement does not justify the expense of additional wet-working steps for most product specifications. However, when maximum wipe dry improvement is desired, additional wet-working can be practiced.

The term "light compression nip" refers to a nip that exerts light compressive forces upon the web, forces of a magnitude that will not substantially compress the web (e.g., will not increase the density by more than about 30%). Such wet working is significantly lighter than the wet pressing step normally encountered in wet-lay papermaking. A light compression nip is formed by rollers having a gap less than the thickness of the web. When the rollers are touching weight can be applied to one or both rollers in order to increase the compressive forces. A typical roller loading is in the range of from about 1 to about 15 pounds per inch of roller length. Such loading in the nip will not increase the density of most webs by more than about 30%. It is preferred to wet work the web with minimum compression and densification to prevent the reduction of the liquid holding capacity of the web. Preferably, the density of the web after wet working and drying is less than about 0.16 gms/cc.

The dry formed, adhesively bonded, non-woven web, (10) can be produced by the process depicted in FIG. 1, top line. The web is formed by a RANDO-WEBBER or other suitable dry-web former. Next, adhesive is applied and usually dried or cured sufficiently to give structural integrity to the web sufficient to permit subsequent manufacturing or converting procedures to be performed on the web. The structural state of the web at this point is referred to as "adhesively bonded" which could be at some intermediate point in a web forming manufacturing process such as during the preliminary drying prior to creping, embossing or similar manufacturing operations. Some adhesive bonding could be accomplished by water creating hydrogen bonds sufficient to give the web sufficient integrity to undergo subsequent manufacturing or finishing operations.

FIG. 1 depicts a process for practicing the present invention in which a dry formed, adhesively bonded, nonwoven fabric or fleece, 10, is wet with a water and surfactant, 11, and then passed through the nip of rollers, 12, in which the gap between the rollers is smaller than the thickness of the web thereby lightly compressing the web as it passes between the rollers which causes mechanical movement of the fibers with respect to each other. The process is depicted with three sets of rollers that wet work the web three times in the same direction. The wet worked web is then dried in dryer 13 to produce a nonwoven, surfactant treated product 14 having noticeably improved wipe-dry characteristics.

The drying of the web after wet-working need not be to the bone dry state but commercially acceptable dryness is adequate. Commercially acceptable dryness contains moisture (e.g., 95% dry) which does not substantially interfere with the function of the product.

Although wet working is depicted in FIG. 1 as a compressive operation with rollers, other procedures that wet-work the fibers and distribute the surfactant without significant compression of the web are suitable and are preferred when the reduced capacity of the web associated with compression is not desired.

The surfactant solution, 11, can be applied in any convenient manner such as by spraying on one or both sides of the web. Furthermore, the surfactant need not be added simultaneously with the water but can be applied to the web as a separate solution either during the making of the web (top line of FIG. 1) or the post treatment portion of the process (lower line of FIG. 1).

Wipe dry capability of nonwoven webs for liquid spills were tested by the following procedure:

first, a sample of the web being tested is mounted on a padded surface of a sled (10 cm × 6.3 cm);

second, the sled is mounted on an arm designed to traverse the sled across a rotating disk;

third, the sled is weighted so that the combined weight of the sled and sample is about 768 grams;

fourth, the sled and traverse arm are positioned on a horizontal rotatable disc with the sample being pressed against the surface of the disc by the weighted sled (the sled and traverse arm being positioned with the leading edge of the sled (6.3 cm side) just off the center of the disc and with the 10 cm centerline of the sled being positioned along a radial line of the disc so that the trailing 6.3 cm edge is positioned near the perimeter of the disc);

fifth, one-half cc of surfactant treated water is placed on the center of the disc in front of the leading edge of the sled (sufficient surfactant is added to the water so that it leaves a film when wiped rather than discrete droplets). For this test a 0.1% Tergitol 15-S-15 solution was used;

sixth, the disc having a diameter of about 60 centimeters, is rotated at about 65 rpm while the traverse arm moves the sled across the disc at a speed of about 2½ centimeters per second until the trailing edge of the sled crosses off the outer edge of the disc at which point the test is stopped (about 15 seconds from start to finish of the test);

seventh; the wiping effect of the test sample upon the water solution is observed during the test as the sled wipes across the disc, in particular the wetted surface is observed and a wiped dry area appears at the center of the disc and enlarges radially on the disc;

eighth, at the moment the test is stopped (when the trailing edge of the sled passes off the edge of the disc) the size of the wiped dry area in square centimeters at the center of the disc is observed (if any).

The test is performed under constant temperature and relative humidity conditions (70° F ± 2° F, 65% relative humidity ± 2%). The test is repeated and the average of the wiped dry area observations (step 8) in square centimeters is defined as the wipe dry index for the sample being tested. To aid in the observation of the size of the area on the disc wiped dry by the test sample (steps 7 and 8), concentric circular score lines are made on the surface of the disc corresponding to the 50, 100, 200, 300, 400, 500 and 750 square centimeter circles so that the side of the dry area can be quickly determined by visually comparing the dry area to a reference score line of known area.

Figure 2:
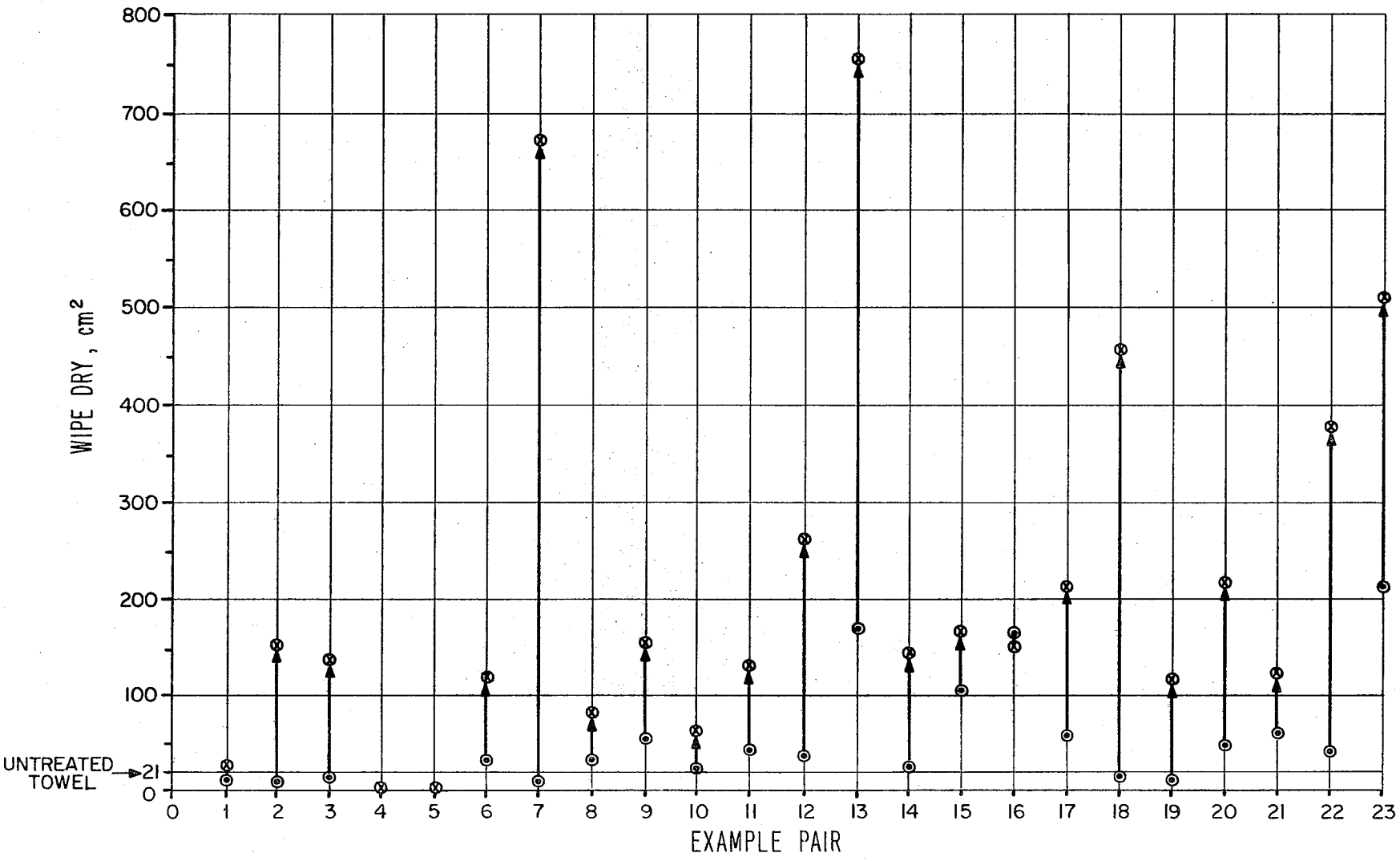
FIG. 2 graphically depicts the improvement in wipe-dry performance obtained by wet working the webs.

The wipe dry index obtained by the above test procedure can be better understood with reference to FIG. 2 which has a vertical axis graduated in wipe dry index values of from 0 to 800. In Example II the wipe dry area on the center of the disc with the non wet worked sample was about 14 $cm^2$ while the wipe dry area with the wet-worked sample was about 155 $cm^2$. In Example IV there was essentially no wipe dry area (trace of dryness).

EXAMPLES 0 AND I TO XXIII

Samples of an adhesively bonded, embossed, low density, dry formed web (Scott Shoptowel® having the characteristics shown as Example 0 in Table I) were treated according to the present invention and also by a comparison process. Specifically, a control sample of untreated web was tested for its wipe dry rating. In comparison to the control, twenty-three pairs of samples (Example pairs 1 to 23) were prepared to test eleven different surfactant solutions and plain water as the wetting solution. Each surfactant was tested at two different levels of addition of surfactant on the web. In all examples a water based solution was added to the web to result in the percent add on of surfactant to the web indicated in Table I. Each sample in an example pair was treated with the same wetting solution at the same level of addition. Only one sample in each pair was wet-worked and then both samples were dried. The wet-working consisted of passing the sample through the nip of a 14 inch wide laboratory padder (rollers having no gap and a loading of 100 lbs.). This procedure was repeated five times with the same edge of the sample entering the nip each time. After wet-working, the samples were dried and tested for wipe dry according to the procedure described above in which the rotating disc was wetted with 0.5 milliliters of a water solution containing 0.1% Tergitol® 15-S-15. The wipe dry index for each sample in square centimeters was determined and reported in Table 1. Table 1 also contains various properties for the treated samples such as the basis weight, density, thickness, length of overhang in both the machine and cross-machine direction (LOMD and LOCD), the dry tensile in both machine direction and cross-machine direction, and wet tensile. The absorption capacity of the treated web was also tested in terms of grams of solution per gram of web which is reported in Table 1. The examples were repeated and the data in Table I are average values. The wipe dry characteristics are depicted on FIG. 2.

SIGNIFICANCE

FIG. 2 graphically depicts the significance of the examples which demonstrate the improvements in wipe dry characteristics obtained by the combination of surfactant and wet-working. The wipe dry index of the wet worked sample in each pair is plotted with "⊗" representing the data point while the data point for the non wet worked sample is plotted with "O".

Both samples in each pair were treated with the same solution at the same addition level followed by drying. However, one sample in each pair was wet-worked prior to drying and surprisingly had noticeably improved wipe dry characteristics. The wet worked sample showed improved wipe-dry characteristics at one or more levels of addition. The cationic surfactant, Triton® X-400 apparently does not have sufficient functionality as a surfactant on the nonwoven web being employed in order for the wipe dry test procedure to detect any improvement in the wipe dry characteristics. Whether padded or unpadded, all samples employing Triton® X-400 produce merely a trace of dryness or almost no dry surface area on the rotating disc after the tests (Examples IV and V). At the higher level of addition, one surfactant did not show improved wipe dry (Example pair 16).

The surfactants used in the examples are described in Table 1 by a reference letter. These surfactants can be more particularly described as follows.

(a) Triton® X-400 is a cationic surfactant commercially available as a paste at 82% or a 25% concentration solution from Rohm & Haas Company and is a stearyl dimethylbenzyl ammonium chloride.

(b) Arquad® 18-50 is a cationic quaternary ammonium surfactant available from Armak Company as a liquid and can be chemically defined as N-alkyl trimethyl ammonium chloride in which the alkyl group is a mixture of about 6% hexadecyl, 93% octadecyl and about 1% octadecenyl.

(c) Emcol® CC-10 is a cationic surfactant available from Witco Chemical Corporation and can be chemically defined as polypropoxylated quaternary ammonium chloride.

(d) Tergitol® 15-S-15 is a nonionic surfactant available from Union Carbide Corporation. Chemically, Tergitol 15-S-15 is an ethoxylated secondary alcohol produced by ethoxylating a mixture of linear secondary alcohols containing from 11 carbon atoms to 15 carbon atoms with a hydrophylic moiety containing 15 ethylene oxide groups.

(e) Miranol® C2M CONC, is a amphoteric surfactant available from The Miranol Chemical Company Incorporated and is a dicarboxylate of coconut oil having an average molecular weight of about 488 and alkyl chain length about 11 and typical formula as follows:

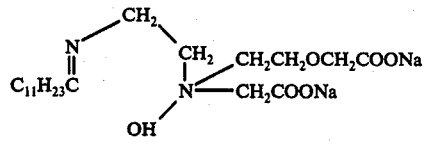

(f) Igepal® CO-630 is a nonionic surfactant available from GAF Corporation. Chemically Igepal CO-630 is monylphenoxypoly(ethy-leneoxy)ethanol having the formula

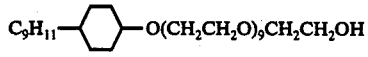

(g) Deceresol® P Special is a nonionic detergent available from American Cynamide Company as a liquid solution containing 42% active ingredients which can be described chemically as modified akylarylsulfonate.

(h) Infrasan® C is a nonionic surfactant available from Reilly-Whiteman Company and is an alkanolamide of coconut derived fatty acids. The predominant ingredient is lauryl diethanolamide which has the following general formula

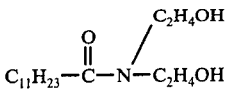

(i) Igepon® TC-42 is an anionic detergent available from GAF Corportion as a liquid solution containing 24% active ingredients. The surfactant is sodium N-coconut acid-N-methyltaurate.

(j) Aerosol® OS is an anionic surfactant available from American Cyanamid Company. Aerosol® OS can be defined chemically as sodium isopropyl naphthalene sulfonate which has the following general formula

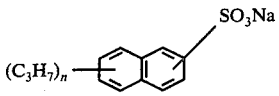

Aerosol® OS has a molecular weight of about 205.

(k) Aerosol® OT 75 is an anionic surfactant available from American Cyanamid Corporation as a liquid solution containing 75% by weight active ingredients. The active ingredient is sodium dioctyl sulfosuccinate having a molecular weight of about 444 and having a chemical structure as follows

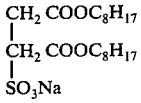

The above listing of surfactants represent a very diverse sampling of surfactants including anionic, nonionic, cationic and amphoteric types which employ substantially different hydrophobic and hydrophylic moieties and accordingly represent a reasonable sampling of the various types of surfactants in terms of ionic charge and hydrophylic and hydrophobic moieties available to the art.

Typical commercially available surfactants which are believed suitable are listed in McCutcheon's Detergents and Emulsifiers, 1974 Annual, published by Allured Publishing Co., Ridgway, N.J., U.S.A., 07450.

A listing of suitable surfactants defined by ionic charge and chemical composition are as follows:

TABLE II

1. Anionic surfactants suitable for use in this invention include both soap and nonsoap detergent compounds. Examples of suitable soaps are the sodium, potassium, ammonium and alkyl-ammonium salts of higher fatty acids ($C_{10}$–$C_{20}$). Particularly useful are the sodium or potassium salts of the mixture of fatty acids derived from coconut oil and tallow, i.e., sodium or potassium tallow and coconut soap. Examples of anionic organic non-soap detergent compounds are the water-soluble salts, alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in this term alkyl is the alkyl portion of higher acyl radicals). Important examples of the synthetic detergents which form a part of the compositions of the present invention are the sodium or potassium alkyl sulfates especially those obtained by sulfating the higher alcohols ($C_8$–$C_{18}$ carbon atoms) produced by reducing the glycerides of tallow or coconut oil; sodium or potassium alkyl benzenesulfonates, such as are described in U.S. Pats. and No. 2,220,009 and No. 2,477,383 in which the alkyl group contains from about 9 to about 15 carbon atoms; other examples of alkali metal alkylbenzene sulfonates are those in which the alkyl radical is a straight chain aliphatic radical containing from about 10 to about 20 carbon atoms for instance, 2-phenyl-dodecanesulfonate and 3-phenyl-dodecanesulfonate; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole or a higher fatty alcohol (e.g., tallow or coconut oil alcohols) and about 1 to 6 moles of ethylene oxide; sodium or potassium salts of alkylphenol ethylene oxide ether sulfate with about 1 to about 10 units of ethylene oxide per molecule and in which the alkyl radicals contain about 9 to about 12 carbon atoms; the reaction product or fatty acids esterfied with isethionic acid and neutralized with sodium hydroxide where, for example, the fatty acids are derived from coconut oil; sodium or potassium salts of fatty acid amide of a methyl tauride in which the fatty acids, for example, are derived from coconut oil; and others known in the art, a number being specifically set forth in U.S. Patents Nos. 2,486,921; 2,486,922; and 2,396,278.

2. Nonionic surfactants suitable for use in this invention may be broadly defined as compounds aliphatic or alkylaromatic in nature which do not ionize in water solution. For example, a well known class pf nonionic synthetic detergents is made available on the market under the trade name of "Pluronic." These compounds are formed by condensing ethylene oxide with a hydrophobic base formed by the condensation of propylene oxide with propylene glycol. The hydrophobic portion of the molecule which, of course, exhibits water insolubility has a molecular weight of from about 1,500 to 1,800. The addition of polyoxyethylene radicals to this hydrophobic portion tends to increase the water solubility of the molecules as a whole and the liquid character of the product is retained up to the point where polyoxyethylene content is about 50% of the total weight of the condensation product.

Other suitable nonionic synthetic detergents include:

(a) The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 25 moles of ethylene oxide per mole of alkyl phenol. The alkyl substitute in such compounds may be derived from polymerized propylene, diisobutylene, octene, or nonene, for example.

(b) Those derived from the condensation of ethylene oxide with the product resulting from the reaction of propylene oxide and ethylenediamine. For example, compounds containing from about 40% to about 80% polyoxyethylene by weight and having a molecular weight of from about 5,000 to about 11,000 resulting from the reaction of ethylene oxide groups with a hydrophobic base constituted of the reaction product of ethylenediamine and excess propylene oxide, said hydrophobic base having a molecular weight of the order of 2,500 to 3,000 are satisfactory.

(c) The condensation product of aliphatic alcohols having from 8 to 18 carbon atoms, in either straight chain or branched chain configuration, with ethylene oxide, e.g., a coconut alcohol-ethylene oxide condensate having from 10 to 30 moles of ethylene oxide per mole of coconut alcohol, the coconut alcohol fraction having from 10 to 14 carbon atoms.

(d) Long chain tertiary amine oxides corresponding to the following general formula, $R_1R_2R_3N \rightarrow O$, wherein $R_1$ is an alkyl radical of from about 8 to 18 carbon atoms, and $R_2$ and $R_3$ are each methyl or ethyl radicals. The arrow in the formula is a conventional representation of a semipolar bond. Examples of amine oxides suitable for use in this invention include dimethyldodecylamine oxide, dimethyloctylamine oxide, dimethyldecylamine oxide, dimethyltetradecylamine oxide, dimethylhexadecylamine oxide.

(e) Long chain tertiary phosphine oxides corresponding to the following formula $RR'R'' \rightarrow O$, wherein R is an alkyl, alkenyl or monohydroxyalkyl radical ranging from 10 to 18 carbon atoms in chain length and R′ and R″ are each alkyl or monohydroxyalkyl groups containing from 1 to 3 carbon atoms. The arrow in the formula is a conventional representation of a semipolar bond. Examples of suitable phosphine oxides are:

Dimethyldodecylphosphine oxide, Dimethyltetradecylphosphine oxide, Ethylmethyltetradecylphosphine oxide, Cetyldimethylphosphine oxide, Dimethylstearylphosphine oxide, Cetylethylpropylphosphine oxide, Diethyldodecylphosphine oxide, Diethyltetradecylphosphine oxide, Bis(hydroxymethyl)dodecylphosphine Bis(2-hydroxyethyl)dodecylphosphine oxide, 2-hydroxypropylmethyltetradecylphosphine oxide, Dimethyloleylphosphine oxide, and Dimethyl-2-hydroxydodecylphosphine oxide.

(f) Dialkyl sulfoxides corresponding to the following formula, $RR'S \rightarrow O$, wherein R is an alkyl, alkenyl, beta- or gamma-monohydroxyalkyl radical or an alkyl or beta- or gamma-monohydroxyalkyl containing one or two other oxygen atoms in the chain, the R groups ranging from 10 to 18 carbon atoms in the chain length, and wherein R′ is methyl or ethyl. Examples of suitable sulfoxide compounds are:

Dodecyl methyl sulfoxide, Tetradecyl methyl sulfoxide, 3-hydroxytridecyl methyl sulfoxide, 2-hydroxydodecyl methyl sulfoxide, 3-hydroxy-4-decoxybutyl methyl sulfoxide, 3-hydroxy-4-dodecoxybutyl methyl sulfoxide, 2-hydroxy-3-decoxypropylmethyl sulfoxide, 2-hydroxy-3-dodecoxypropyl methyl sulfoxide, Dodecyl ethyl sulfoxide, and 2-hydroxydodecyl ethyl sulfoxide.

3. Typical cationic surfactants suitable for use in this invention are compounds having one of the following generic formulas

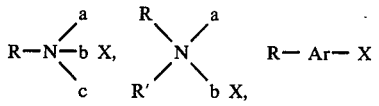

where R and R′ are hydrophobic alkyl or alkylaryl groups containing 10 or more carbon atoms, a, b, and c are methyl, ethyl, or benzyl groups, AR is a nitrogen-containing aromatic group, and X is halide, sulfate, methosulfate or ethosulfate. Examples of R and R′ are saturated unsaturated alkyl groups having 10 to 18 carbon atoms (cetyl, lauryl, myristyl, stearyl, oleyl) and mixtures of these such as those derived from natural products such as tallow and mono- and dialkylbenzyl groups; examples of AR are pyridine and isoquinoline and the like. Typical examples of cationic surfactants are the following quaternary ammonium compounds:

Trimethyl methyldodecylbenzyl ammonium chloride, Trimethyl cetyl ammonium chloride, Trimethyl stearyl ammonium chloride, Trimethyl tallow ammonium chloride, Dimethyl dioctyl ammonium chloride, Dimethyl octyl decyl ammonium chloride, Dimethyl didecyl ammonium chloride, Dimethyl octyl dodecyl ammonium chloride, Dimethyl distearyl ammonium chloride, Dimethyl ethyl cetyl ammonium chloride, Dimethyl dodecyl 2-phenoxyethyl ammonium chloride, Dimethyl di(tallow) ammonium chloride, Dimethyl benzyl tallow ammonium chloride, Dimethyl benzyl cetyl ammonium chloride, Dimethyl benzyl lauryl ammonium chloride, Dimethyl benzyl myristyl ammonium chloride, Dimethyl benzyl stearyl ammonium chloride, Dimethyl benzyl di-(isobutyl cresoxy ethoxy) ethyl ammonium chloride, Dimethyl benzyl di-(isobutyl phenoxy ethoxy) ethyl ammonium chloride, Lauryl pyridinium chloride, Cetyl pyridinium chloride, Lauryl isoquinolinium chloride, Dioctyldimethylammonium chloride, Didecyldimethylammonium chloride, Didodecyldimethylammonium chloride, Ditetradecyldimethylammonium chloride, Dihexadecyldimethylammonium chloride, Dioctadecyldimethylammonium chloride, Dioleyldimethylammonium chloride, Di(hydrogenated tallow) dimethylammonium chloride, Di(tall oil) dimethylammonium chloride, Di-coco dimethylammonium chloride, Benzyldidodecylmethylammonium chloride, Benzyldicocomethylammonium chloride, Benzyldi(hydrogenated tallow) methylammonium chloride, Trioctylmethylammonium chloride, Tridodecylmethylammonium chloride, Tricocomethylammonium chloride, Dodecyltrimethylammonium chloride, Tetradecyltrimethylammonium chloride, Hexadecyltrimethylammonium chloride, 9-octadecenyltrimethylammonium chloride, Octadecyltrimethylammonium chloride, Tallow trimethylammonium chloride, Soya trimethylammonium chloride, Cotton trimethylammonium chloride, Tall oil trimethylammonium chloride, Coco trimethylammonium chloride, Dodecylbenzyldimethylammonium chloride, Coco benzyl dimethylammonium chloride, Hydrogenated tallow benzyldimethylammonium chloride, Dodecylbenzyl hydrogenated tallow dimethylammonium chloride, Dodecylbenzyltri(octyldecyl)ammonium chloride.

TABLE I

| EXAMPLE | WET WORKED | SURFACTANT TYPE | SURFACTANT CONC. | ADD-ON % | BS. WT. #/rm. | THICKNESS IN. | LOMD CM | LOCD CM | MDT #/in. | CDT #/in. | MDT Wet #/in. | CAPACITY gm/gm cm$^2$ | WIPE DRY | DENSITY gm/cm$^3$ |
|---|---|---|---|---|---|---|---|---|---|---|---|---|---|---|
| 0 | NO | — | — | — | 85.3 | .047 | 13.4 | 11.0 | 5.47 | 4.57 | 3.63 | 624 | 21 | .121 |
| 1 | NO | $H_2O$ | 100 | — | 79.2 | .054 | 12.7 | 9.7 | 4.74 | 3.37 | 2.69 | 652 | 11 | .095 |
| 1 | YES | $H_2O$ | 100 | — | 88.3 | .042 | 12.4 | 9.4 | 5.87 | 3.15 | 2.77 | 571 | 25 | .140 |
| 2 | NO | i | 4% | 2 | 94.7 | .059 | 12.7 | 9.9 | 3.58 | 2.86 | 2.82 | 618 | 14 | .107 |
| 2 | YES | i | 4% | 2 | 83.0 | .039 | 11.2 | 9.0 | 3.02 | 2.54 | 2.11 | 535 | 155 | .142 |
| 3 | NO | i | 8% | 4 | 106.7 | .057 | 13.8 | 11.1 | 6.62 | 3.36 | 4.47 | 516 | 12 | .125 |
| 3 | YES | i | 8% | 4 | 94.6 | .043 | 11.1 | 8.7 | 3.92 | 3.07 | 2.78 | 528 | 135 | .144 |
| 4 | NO | a | 4% | 2 | 100.2 | .057 | 13.8 | 9.8 | 6.70 | 3.50 | 4.27 | 591 | T | .117 |
| 4 | YES | a | 4% | 2 | 94.3 | .046 | 12.4 | 9.1 | 5.02 | 3.57 | 2.47 | 564 | T | .143 |
| 5 | NO | a | 8% | 4 | 98.5 | .057 | 13.3 | 11.8 | 4.45 | 4.35 | 2.83 | 558 | T | .115 |
| 5 | YES | a | 8% | 4 | 92.0 | .047 | 13.3 | 10.8 | 5.29 | 3.87 | 3.38 | 501 | T | .131 |
| 6 | NO | g | 4% | 2 | 93.6 | .057 | 13.0 | 10.0 | 5.33 | 4.74 | 3.38 | 553 | 30 | .110 |
| 6 | YES | g | 4% | 2 | 97.8 | .044 | 12.8 | 9.6 | 6.65 | 4.80 | 3.24 | 471 | 123 | .148 |
| 7 | NO | g | 8% | 4 | 100.0 | .057 | 12.2 | 9.6 | 4.53 | 3.94 | 2.82 | 564 | 8 | .117 |
| 7 | YES | g | 8% | 4 | 81.4 | .036 | 10.0 | 8.7 | 2.47 | 2.60 | 1.78 | 537 | 680 | .151 |
| 8 | NO | j | 4% | 2 | 98.3 | .057 | 13.7 | 10.5 | 6.94 | 4.43 | 3.79 | 608 | 28 | .115 |
| 8 | YES | j | 4% | 2 | 88.4 | .048 | 11.9 | 9.3 | 5.40 | 4.21 | 2.81 | 509 | 81 | .123 |
| 9 | NO | j | 8% | 4 | 98.6 | .058 | 14.1 | 10.6 | 8.07 | 4.14 | 3.57 | 540 | 56 | .113 |
| 9 | YES | j | 8% | 4 | 92.9 | .048 | 13.3 | 9.3 | 6.54 | 4.55 | 3.38 | 531 | 156 | .129 |
| 10 | NO | h | 4% | 2 | 100.4 | .058 | 13.5 | 10.1 | 5.75 | 3.31 | 3.25 | 638 | 22 | .116 |
| 10 | YES | h | 4% | 2 | 105.4 | .046 | 13.6 | 10.3 | 8.28 | 5.68 | 4.50 | 464 | 66 | .153 |
| 11 | NO | h | 4% | 4 | 100.1 | .059 | 13.1 | 9.6 | 5.42 | 2.86 | 3.24 | 570 | 45 | .113 |
| 11 | YES | h | 4% | 4 | 98.9 | .048 | 12.6 | 9.6 | 6.80 | 3.28 | 4.13 | 533 | 130 | .137 |
| 12 | NO | d | 4% | 2 | 83.1 | .051 | 11.4 | 9.7 | 3.14 | 2.70 | 2.53 | 625 | 37 | .109 |
| 12 | YES | d | 4% | 2 | 88.8 | .038 | 10.9 | 8.2 | 5.40 | 3.40 | 2.96 | 555 | 235 | .156 |
| 13 | NO | d | 8% | 4 | 91.1 | .053 | 10.7 | 9.0 | 2.22 | 1.99 | 2.00 | 647 | 175 | .115 |
| 13 | YES | d | 8% | 4 | 87.8 | .040 | 10.5 | 8.3 | 3.46 | 2.34 | 563 | 755 | .146 | |
| 14 | NO | c | 4% | 2 | 96.5 | .057 | 12.1 | 8.9 | 5.58 | 4.09 | 3.83 | 550 | 23 | .113 |
| 14 | YES | c | 4% | 2 | 96.7 | .045 | 11.0 | 7.7 | 5.11 | 3.60 | 3.07 | 518 | 144 | .143 |
| 15 | NO | c | 8% | 4 | 92.9 | .054 | 11.1 | 8.3 | 3.51 | 3.31 | 2.83 | 619 | 107 | .115 |
| 15 | YES | c | 8% | 4 | 84.4 | .041 | 9.8 | 7.9 | 2.71 | 2.78 | 2.28 | 590 | 173 | .137 |
| 16 | NO | k | 4% | 2 | 93.0 | .056 | 12.4 | 8.9 | 3.87 | 3.90 | 3.10 | 491 | 167 | .111 |
| 16 | YES | k | 4% | 2 | 87.3 | .044 | 12.4 | 9.3 | 4.66 | 3.84 | 2.84 | 559 | 155 | .132 |
| 17 | NO | k | 8% | 4 | 93.9 | .058 | 12.0 | 9.0 | 5.76 | 4.40 | 2.88 | 461 | 64 | .108 |
| 17 | YES | k | 8% | 4 | 101.8 | .046 | 11.7 | 10.3 | 6.84 | 5.70 | 4.04 | 527 | 212 | .148 |
| 18 | NO | b | 4% | 2 | 88.6 | .057 | 13.1 | 10.1 | 2.96 | 2.99 | 1.93 | 701 | 15 | .104 |
| 18 | YES | b | 4% | 2 | 95.1 | .044 | 12.8 | 9.9 | 5.26 | 3.92 | 3.92 | 515 | 455 | .144 |
| 19 | NO | b | 8% | 4 | 95.0 | .056 | 13.9 | 10.9 | 5.34 | 4.12 | 3.18 | 540 | 8 | .113 |
| 19 | YES | b | 8% | 4 | 87.6 | .045 | 12.5 | 10.8 | 4.25 | 3.19 | 2.35 | 501 | 110 | .130 |
| 20 | NO | f | 4% | 2 | 100.0 | .053 | 12.7 | 9.9 | 6.20 | 4.00 | 4.39 | 559 | 47 | .126 |
| 20 | YES | f | 4% | 2 | 91.7 | .042 | 14.5 | 9.1 | 5.10 | 4.50 | 2.76 | 495 | 215 | .146 |
| 21 | NO | f | 8% | 4 | 96.0 | .050 | 12.1 | 9.1 | 4.93 | 3.67 | 2.80 | 553 | 59 | .128 |
| 21 | YES | f | 8% | 4 | 99.4 | .045 | 11.7 | 9.4 | 5.77 | 4.90 | 4.40 | 462 | 125 | .147 |
| 22 | NO | e | 4% | 2 | 78.0 | .052 | 12.0 | 9.2 | 2.02 | 3.14 | 2.21 | 581 | 44 | .100 |
| 22 | YES | e | 4% | 2 | 94.0 | .043 | 12.5 | 9.2 | 6.34 | 4.26 | 1.56 | 461 | 380 | .146 |
| 23 | NO | e | 8% | 4 | 88.7 | .055 | 12.2 | 9.7 | 4.62 | 3.93 | 2.64 | 545 | 214 | .108 |
| 23 | YES | e | 8% | 4 | 99.4 | .043 | 12.5 | 9.1 | 6.96 | 4.29 | 4.23 | 487 | 510 | .154 |

What is claimed is:

1. A method of improving the wipe dry characteristic of a dry-formed, adhesively bonded, web having a density less than about 0.16 grams/cubic centimeter, comprising;

wetting the web with water and with from about 0.5% to about 3% of a surfactant, working the wet web to cause relative movement of the fibers comprising the web with respect to each other, and drying the web.

2. The method of claim 1, wherein the surfactant is an anionic surfactant.

3. The method of claim 1, wherein the surfactant is a cationic surfactant.

4. The method of claim 1, wherein the surfactant is a nonionic surfactant.

5. The method of claim 1, wherein the surfactant is an amphoteric surfactant.

6. The method of claim 1 wherein the surfactant is added to the web prior to the addition of water.

7. The method of claim 1, wherein the surfactant addition onto the web is about 2% by weight.

8. The method of claim 1, wherein the wet working comprises compressing the web by passing the wetted web through rollers having a gap between rollers less than the thickness of the web, said compressing being insufficient to increase the density of the web by 30% in comparison to the density of the wet web prior to wet working.

9. The method of the claim 8, wherein the wet working is repeated at least three times by passing the web through at least three sets of rollers.

10. The method of claim 1, wherein the web is embossed to produce densified regions on the surface of the web prior to wetting and treating with the surfactant.

11. The method of claim 1, wherein the drying removes sufficient moisture to result in a web having less than about 5% moisture content based upon the dry weight of the web.

12. The method of claim 1, wherein the adhesive has been dried and cured prior to wet working to impart sufficient bonding of the fibers in the web so that the web has sufficient machine direction strength to permit creping of the web from a creping surface.

13. The method of claim 1, wherein the drying of the web further cures or dries the adhesive.

14. The method of claim 1, wherein the surfactant is an ethoxylated secondary alcohol produced by ethoxylating a mixture of linear secondary alcohols containing from 11 carbon atoms to 15 carbon atoms with a hydrophylic moiety containing 15 ethylene oxide groups.

15. The method of claim 1, wherein the surfactant is a liquid solution containing modified akylarylsulfonate.

16. The method of claim 1, wherein the surfactant is N-alkyl trimethyl ammonium chloride in which the alkyl group is a mixture of about 6% hexadecyl, 93% octadecyl and about 1% octadecenyl.

17. The method of claim 1, wherein the wetting of the web with water is sufficient to add at least about 30% water based upon the dry weight of the web.

18. The method of claim 1, wherein the wet working comprises passing the web through an embossing roll step.

19. The improved web produced according to the method of claim 1.

20. The improved web of claim 19 having a basis weight of from 80 to 120 pounds/ream.

21. The improved web produced according to the method of claim 8.

22. The improved web produced according to the method of claim 13.

* * * * *